United States Patent [19]

Howell

[11] Patent Number: 4,717,798

[45] Date of Patent: Jan. 5, 1988

[54] LOW VOLTAGE VACUUM CIRCUIT INTERRUPTER

[75] Inventor: Edward K. Howell, Simsbury, Conn.

[73] Assignee: General Electric Company, New York, N.Y.

[21] Appl. No.: 20,430

[22] Filed: Mar. 2, 1987

Related U.S. Application Data

[62] Division of Ser. No. 770,931, Aug. 30, 1985, Pat. No. 4,667,071.

[51] Int. Cl.[4] ..... H01H 33/66

[52] U.S. Cl. ..... 200/144 B

[58] Field of Search ..... 200/144 B, 83 N

*Primary Examiner*—Robert S. Macon

*Attorney, Agent, or Firm*—Richard A. Menelly; Walter C. Bernkopf; Fred Jacob

[57] ABSTRACT

A solid state switch connected across a pair of separable contacts for eliminating arcing across the contacts allows the contacts and the contact driver to be enclosed within an evacuated envelope. The vacuum environment allows the use of an inexpensive, highly conductive contact material, such as copper, without fear of chemical reaction.

6 Claims, 2 Drawing Figures

LOW VOLTAGE VACUUM CIRCUIT INTERRUPTER

This is a division of application Ser. No. 770,931, filed Aug. 30, 1985, now U.S. Pat. No. 4,667,071.

BACKGROUND OF THE INVENTION

The provision of a solid state switch across a pair of separable contacts to reduce arcing between the contacts, when separated, is disclosed within U.S. patent application Ser. No. 610,947 filed May 16, 1984 entitled "Solid State Current Limiting Interrupter" in the name of E. K. Howell and now abandoned. This application is incorporated herein for purposes of reference and should be reviewed for a good description of the circuit components used within the solid state switch.

The absence of an arc between the contacts, when separated, allows smaller contacts which in turn are more readily separated in the early stages of the current waveform to further reduce contact heating and deterioration. U.S. patent application Ser. No. 684,307 filed Dec. 20, 1984 entitled "High Speed Contact Driver For Circuit Interrupter Device now abandoned" and U.S. Pat. No. 4,620,122, entitled "Piezoelectric Contact Driver For Circuit Interrupters", both in the name of E. K. Howell, disclose contact drivers for rapid circuit interruption by means of a pair of fixed contacts and a bridging contact operated by a contact driver. Both the aforementioned U.S. patent application and U.S. Patent are also incorporated herein for purposes of reference. The use of the solid state switch in combination with the high speed contact driver to separate the contacts allows the solid state circuit components to be reduced in rating and hence more economically feasible. U.S. Pat. No. 4,607,148 entitled "Change Of State Contact Material For Electric Circuit Interrupters", also in the name of E. K. Howell, describes a contact structure that allows for a reduction in the contact holding force which is required to provide low contact resistance between the contacts. This results in the use of smaller contacts and contact holding springs. This Application is incorporated herein for purposes of reference and should be reviewed for a good understanding of the materials and arrangement used to promote these benefits.

By the synergistic combination of a solid state switch, high speed contact driver and change of state electrode materials, the size of the contacts and the means for separating the contacts can be reduced sufficiently to enable containment within an evacuated envelope. The use of the evacuated envelope now allows either the fixed contact pair or the bridging contact to be fabricated from copper metal rather than silver. The copper provides good electrical conduction between the contacts along with a substantial reduction in materials costs. The copper remains oxide-free under the vacuum contained within the sealed envelope as well as when reducing-type gases are employed instead of vacuum.

SUMMARY OF THE INVENTION

A low voltage vacuum interrupter consisting of a pair of fixed contacts and a bridging contact under the control of a high speed contact driver are arranged within an evacuated envelope. The fixed contacts comprise copper metal while the bridging contact comprises a change of state layered metal contact. A solid state switch connected across the fixed contact pair allows the contacts to be separated without the occurrence of any arc whatsoever.

DESCRIPTION OF THE PREFERRED EMBODIMENT

Figure 1:
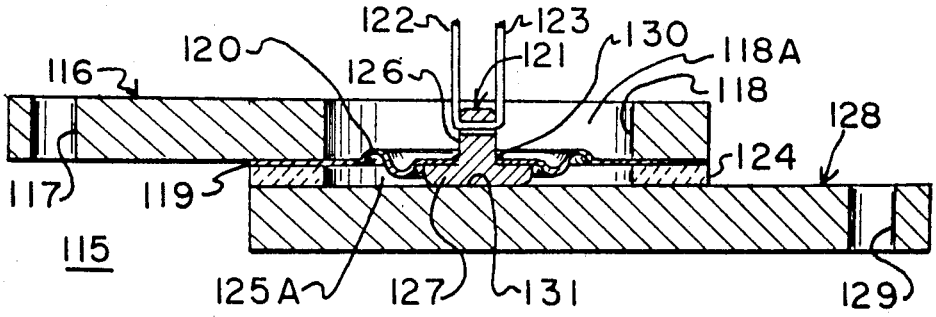
FIG. 1 is a side sectional view of a single break low voltage vacuum interrupter according to the invention.

A low power single break vacuum interrupter 115 is shown in FIG. 1 and consists of a first copper bar 116 having an aperture 117 for electrical connection with an external circuit and a second larger aperture 118 which defines a space 118A, as indicated. Within this space is arranged an apertured and flexible diaphragm 119 containing an expansion diameter 120 and through which a contact rivet 121 is inserted and fixedly attached by means of a bead 130 of silver solder. An apertured stem 126 supports a pair of closely spaced wires 122, 123 for moving the diaphragm and the single contact 127 A single ceramic disc 124 is arranged between the first copper bar 116 and a second copper bar 128. The second copper bar contains an aperture 129 at one end for electrical connection with an external circuit. The single contact 127 mates with a surface of the second copper bar shown generally at 131 to provide an electrically conductive path from the second copper bar 128 through the single contact 127 and diaphragm 119 to the first copper bar 116. When a current pulse is applied to the closely spaced wires 122, 123 the force applied to the contact rivet 121 lifts the diaphragm and the single contact out of contact with the second copper bar 128 to interrupt the electrical connection between the first and second copper bars.

Figure 2:
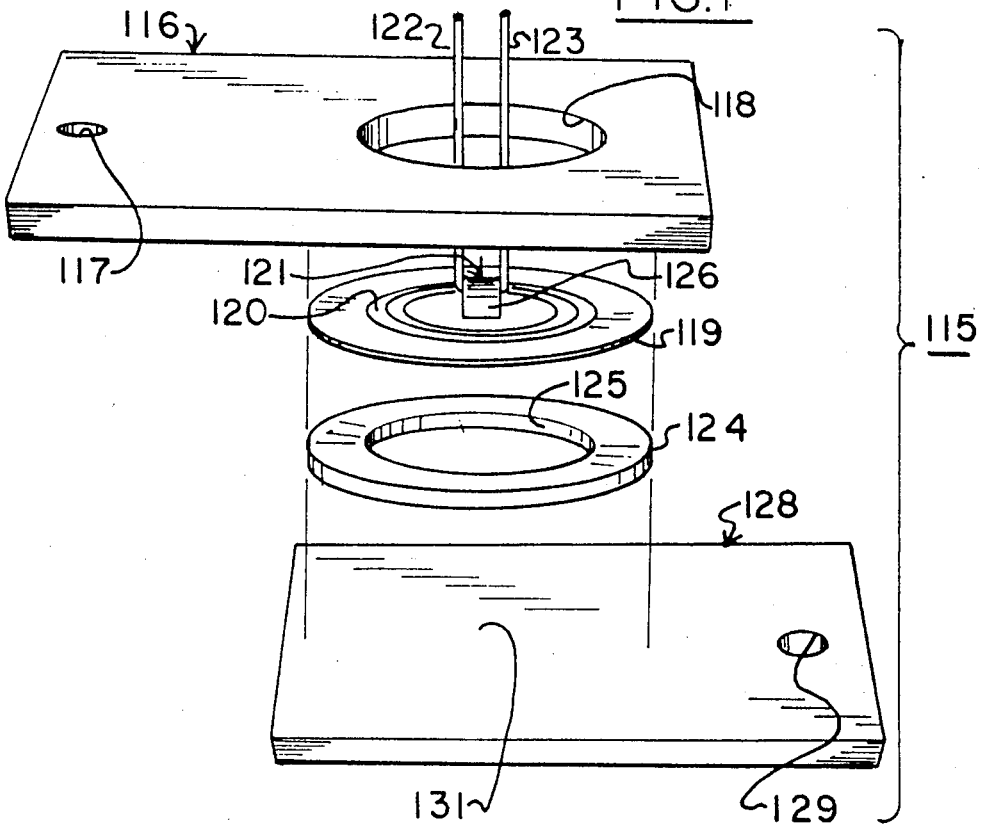
FIG. 2 is an exploded top perspective view of the low voltage interrupter of FIG. 2 prior to assembly.

The low power single break vacuum interrupter of FIG. 1 is assembled in the manner depicted in FIG. 2 and described as follows. The second copper bar 128 is arranged with the aperture 129 oriented opposite from the aperture 117 through the first copper bar 116. The ceramic disc 124 is then arranged on the second copper bar such that the aperture 125 surrounds the contact mating surface generally described at 131 and forms a space generally shown at 125A in FIG. 1. The flexible diaphragm 119 is placed on the ceramic disc with the expansion diameter 120 within the disc aperture and with the contact rivet 121 and apertured stem 126 concentrically arranged within the aperture 118 provided through the first copper bar and with the closely spaced wires 122, 123 extending through the aperture. When the components are assembled as depicted in FIG. 1, they are placed within an evacuation chamber and are evacuated and sealed in the manner described earlier. The low power single contacts vacuum interrupter 115 is useful in circuits wherein the current transport through the flexible diaphragm 119 is insufficient to cause excess heating of the diaphragm.

It is thus seen that the use of a solid state switch across a pair of contacts contained within an evacuated chamber allows the contacts to rapidly separate to interrupt circuit current with little or no deterioration due to arcing or chemical activity. The vacuum also allows the circuit to interrupt upon the occurrence of a very small separation distance because of the excellent dielectric properties inherent in the vacuum environment.

Having described my invention, what I claim as new and desire to secure by Letters Patent is:

1. A single break vacuum interrupter comprising:

closure means including a first apertured metal bar having first means for connection with an external electric circuit and forming a top half of said closure means;

a flexible metal diaphragm having a contact attached to a bottom surface for interrupting current through said external circuit and for hermetically sealing said first metal bar aperture from the atmosphere; and a dielectric disc having a first surface arranged on a second metal bar having second means for connection with said external circuit said second metal bar forming a bottom half of said closure means;

said first apertured metal bar being arranged on said metal diaphragm and said metal diaphragm being arranged on an opposite surface of said dielectric disc for defining an enclosed space which surrounds said contact and an underlying surface on said second metal bar whereby electrical connection is made with said first and second metal bars and said electric circuit when said contact abuts said underlying surface and electrical connection is interrupted between said first and second metal bars and said electric circuit when said contact is away from said underlying surface.

2. The vacuum circuit interrupter of claim 1 further including control means connected with a top surface of said metal diaphragm for moving said metal aperture and said contact to first and second positions, said contact being in contact with said underlying surface in said first position to pass said circuit current through said external circuit and said contact being out of contact with said underlying surface to interupt said circuit current in said second position.

3. The vacuum circuit interrupter of claim 2 wherein said control means comprises a pair of spaced wires attached to said top surface at one end for becoming electrodynamically repulsed upon application of an electric control signal to said spaced wires at an opposite end.

4. The vacuum circuit interrupter of claim 3 wherein said enclosed space is at least partially evacuated for returning said metal diaphragm and said contact to said first position by difference in pressure between atmospheric atmosphere and reduced pressure within said enclosed space when said control signal is removed from said spaced wires.

5. The vacuum circuit interrupter of claim 1 wherein said enclosed space contains a non-oxidizing gas fill.

6. The vaccum circuit interrupter of claim 1 further including a solid state switch across said first and second metal bars for transferring said circuit current away from said contact and said underlying surface prior to or during movement of said contact away from said underlying surface to interrupt said circuit current.

* * * * *